US008986175B2

(12) United States Patent
Batiste et al.

(10) Patent No.: US 8,986,175 B2
(45) Date of Patent: Mar. 24, 2015

(54) EXERCISE APPARATUS AND METHOD THEREFOR

(75) Inventors: Stan Batiste, Granite Bay, CA (US); Steven Achstein, Roseville, CA (US); Daniel Batiste, Granite Bay, CA (US)

(73) Assignee: Myopower, Inc., Fernley, NV (US)

( * ) Notice: Subject to any disclaimer, the term of this patent is extended or adjusted under 35 U.S.C. 154(b) by 834 days.

(21) Appl. No.: 13/045,403

(22) Filed: Mar. 10, 2011

(65) Prior Publication Data

US 2011/0251032 A1 Oct. 13, 2011

Related U.S. Application Data

(60) Provisional application No. 61/312,571, filed on Mar. 10, 2010.

(51) Int. Cl.

| | |
|---|---|
| ***A63B 21/012*** | (2006.01) |
| ***A63B 21/015*** | (2006.01) |
| ***F16C 11/06*** | (2006.01) |
| ***A63B 21/00*** | (2006.01) |
| ***A63B 23/12*** | (2006.01) |

(52) U.S. Cl.

CPC ..... *A63B 21/015* (2013.01); *A63B 21/0004* (2013.01); *A63B 21/00069* (2013.01); *A63B 21/1492* (2013.01); *A63B 23/12* (2013.01); *A63B 21/1476* (2013.01); *A63B 2210/50* (2013.01)

USPC ..... 482/117; 482/114; 403/90

(58) Field of Classification Search

USPC ..... 482/49, 114–119; 403/90

See application file for complete search history.

(56) References Cited

U.S. PATENT DOCUMENTS

| | | | | | |
|---|---|---|---|---|---|
| 2,543,729 | A | * | 2/1951 | Magida | 482/118 |
| 2,928,686 | A | * | 3/1960 | Newkirk | 403/77 |
| 3,198,408 | A | * | 8/1965 | Benner | 223/66 |
| 3,424,419 | A | * | 1/1969 | Siegel | 248/231.71 |
| 4,974,802 | A | * | 12/1990 | Hendren | 248/181.1 |
| 5,098,213 | A | * | 3/1992 | Day | 403/7 |

* cited by examiner

*Primary Examiner* — Loan H Thanh
*Assistant Examiner* — Jennifer M Deichl
(74) *Attorney, Agent, or Firm* — Weide & Miller, Ltd.

(57) ABSTRACT

The total body exercise apparatus comprises a unique movable structure to provide resistance for a variety of exercises. In one or more embodiments, the exercise apparatus comprises arms rotatably secured via a joint that allows the arms to provide resistance in virtually any direction. The exercise apparatus utilizes this capability to resist motions of various exercises and body motions to tone and strengthen a user's muscles. The resistance provided may be adjustable by an adjustable resistance assembly or by a cuff and socket assembly that applies variable force to a spherical head of the joint of the exercise apparatus.

12 Claims, 3 Drawing Sheets

EXERCISE APPARATUS AND METHOD THEREFOR

CROSS-REFERENCE TO RELATED APPLICATION

This application claims priority to U.S. Provisional Application No. 61/312,571 titled Exercise Apparatus and Method Therefor, filed Mar. 10, 2010.

BACKGROUND OF THE INVENTION

1. Field of the Invention

The invention relates to exercise equipment and in particular to a total body adjustable resistance exercise apparatus.

2. Related Art

Traditional exercise equipment typically focuses on one portion of the body or a particular type of exercise. Because of this, a user repeats one or more motions during exercise which causes other portions of his or her body to be neglected. Though there is equipment designed to be reconfigurable for various exercises, typically, this type of equipment is large and unwieldy. In addition, a user must take time and effort to properly reconfigure the equipment for different exercises. This serves as a deterrent to exercise and has a negative effect on whatever motivation a user has to exercise. As such, users are all too often limited in the types of exercise they perform.

From the discussion that follows, it will become apparent that the present invention addresses the deficiencies associated with the prior art while providing numerous additional advantages and benefits not contemplated or possible with prior art constructions.

SUMMARY OF THE INVENTION

The exercise apparatus herein provides resistance in virtually every direction to oppose the motion of a user's body. In this manner, the apparatus tones and strengthens the user's muscles. The apparatus may have two arms which may be moved together and apart while providing resistance to such movement. The arms may be configured to move in any direction to allow a variety of exercises having a broad range of motions. This allows the apparatus to be used for total body exercise.

The exercise apparatus may be configured in various ways. In one embodiment the total body exercise apparatus comprises a first arm, a second arm, and a joint. The first arm may comprise a first end and a second end where the first end has a socket and the second end has a grip. The second arm may comprise its own first end and second end with the first end having a spherical head and the second end having a grip. The joint may comprise the socket, the spherical head, and a cuff. The cuff may secure the spherical head within the socked and comprise an opening to accept the second arm.

An adjustable resistance assembly may be included as well. The adjustable resistance assembly may comprise a friction pad extending from the spherical head, a control knob at the second end of the second arm, and an adjustment rod between the friction pad and the control knob. The adjustment rod may comprise a threaded portion supported by a threaded opening within the second arm. In this manner, rotation of the control knob rotates the adjustment rod causing the friction pad to extend or retract relative to the spherical head. This respectfully increases or decreases friction between the friction pad and the spherical head which correspondingly increases or decreases resistance provided by the exercise apparatus.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE PREFERRED EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

The total body exercise apparatus utilizes a unique movable structure to provide resistance to a broad range of body motions. In fact, in one or more embodiments, the exercise apparatus provides resistance in virtually any direction. The exercise apparatus utilizes this capability to provide various types of exercise of various portions of the body. In this manner, the exercise apparatus provides total body exercise (i.e., exercise for virtually any area of the body).

As will become apparent from the discussion below, the exercise apparatus has numerous advantages. On advantage is that the exercise apparatus may have a relatively small size allowing it to be easily transported, stored, as well as used for various exercises. In addition, the exercise apparatus may provide adjustable resistance to allow users of all ages, strengths, and types to use the apparatus.

Further, as stated, the exercise apparatus has a broad range of motion which allows a variety of exercises to be performed. This allows the exercise apparatus to be very forgiving in that a user may get a good workout without learning or utilizing exact or precise exercise technique. In other words, the problem of the reduced effect of exercise on a user's body because of poor technique is greatly reduced or eliminated. The broad range of motion also reduces the risk of injury because the exercise apparatus may conform its motion to that of the user's body, whatever that may be.

The total body exercise apparatus will now be described with regard to FIGS. 1A-1C. As can be seen, FIG. 1A illustrates an assembled exercise apparatus ready for use, FIG. 1B illustrates an exploded view of the exercise apparatus, and FIG. 1C illustrates a close up of the joint of the exercise apparatus.

Figure 1A:
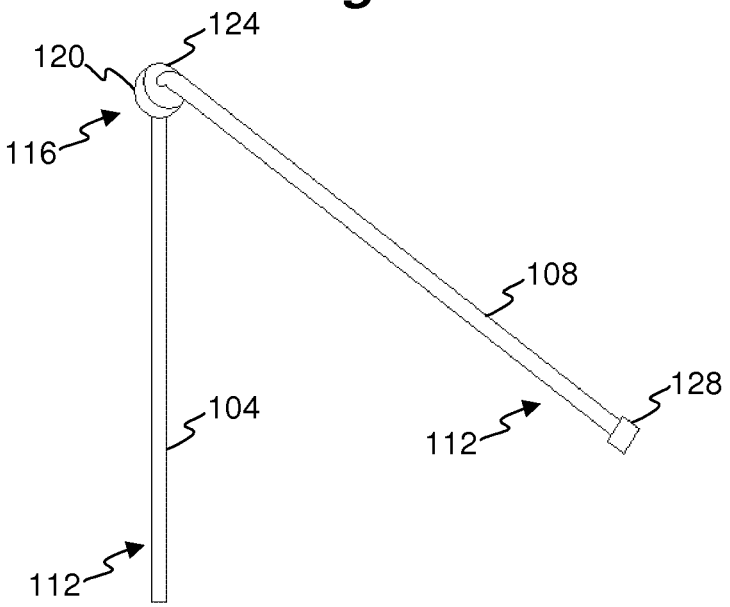
FIG. 1A is a perspective view of an exemplary total body exercise apparatus.
Figure 1B:
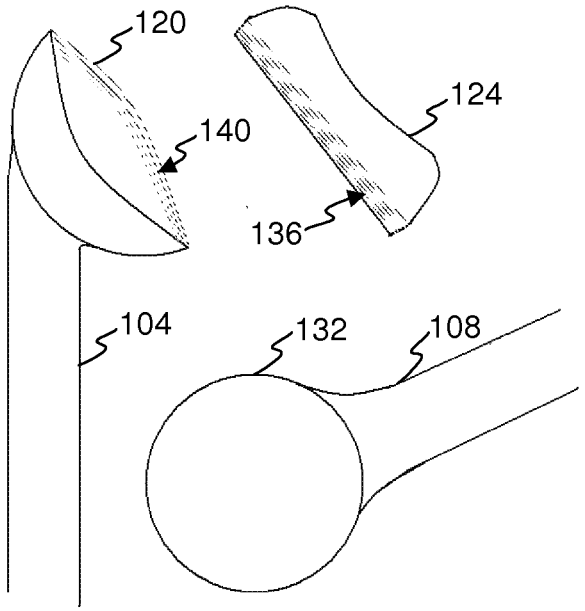
FIG. 1B is an exploded view of an exemplary total body exercise apparatus.
Figure 1C:
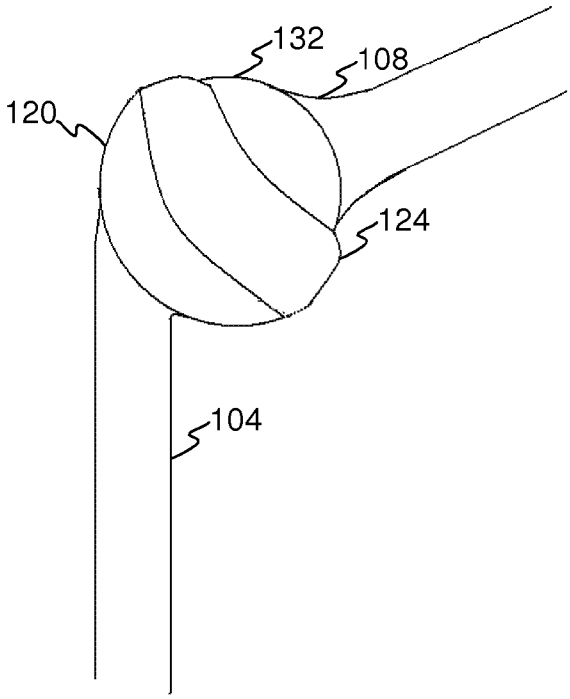
FIG. 1C is a side view of an exemplary joint of a total body exercise apparatus.

Referring to FIG. 1A, in one or more embodiments, the exercise apparatus may comprise two arms 104,108 which may be rotatably connected at a joint 116. The arms 104,108 may be engaged by a user to perform one or more exercises by moving or rotating one or both of the arms 104,108 about the joint 116. As can be seen, the arms 104,108 may be elongated members in one or more embodiments.

Though shown as having a particular length, it is contemplated that the arms 104,108 may be a variety of sizes to accommodate various users. For example, a shorter user may desire an exercise apparatus with shorter arms 104,108 while a taller user may desire longer arms. The arms 104,108 may be extendable or collapsible in one or more embodiments, such as for example, by having one or more inner tubes or members which may extend or retract to respectively lengthen or shorten the arms 104,108. Alternatively or in addition, the arms 104,108 may be modular sections which may be added or removed to respectively lengthen and shorten the arms. For instance, modular sections of the arms 104,108 may be threaded onto or otherwise attached to one another to lengthen the arms. The sections may be removed to shorten the arms. In one embodiment, the sections may comprise a tapered hollow shape which allows them to fit into each other and be held in place by a friction fit. Of course the sections may be attached by other fasteners, such as clips, clamps, pins, or the like.

In addition, the arms 104,108 may be various shapes. As shown for example, the arms 104,108 have a circular cross sectional shape. However, in other embodiments the arms 104,108 may have other cross sectional shapes such as rectangular, square, crescent or other shapes. It is contemplated that various portions of the arms 104,108 may have different shapes. For example the arms 104,108 may have a square cross sectional shape at one end and a circular cross sectional shape at another end. This helps the exercise apparatus provide a variety of exercises. For example, the square section may be used to engage a user's arms or legs while the circular section may be configured for grasping by a user's hands in one or more embodiments.

It is contemplated that a portion or all of the arms 104,108 may include a grip 112 or other enhanced contact area/surface which provides comfort, a gripping surface, or both when the user engages the arms 104,108 during exercise. The grip 112 may comprise various materials. For example, the grip 112 may be a pad or a rubberized area. In one embodiment, the grip 112 may comprise elastic material which conforms to a portion of the user's body. This allows the user to more easily engage and stay engaged to the exercise apparatus when in use. For example, the grip 112 may conform to (e.g., indent to engage) a user's arm, leg, or other body part. In this manner, the grip 112 allows the exercise apparatus to be used with various portions of the body thus allowing total body exercise.

The grip 112 may also include various structures which allow a user to engage the exercise apparatus with various portions of his or her body. For example, the grip 112 may include one or more straps to secure the exercise apparatus to a user's arms, legs, or both. In one embodiment, the grip 112 may comprise a sock, shoe, or similar structure which allows the exercise apparatus to engage a user's foot. In another embodiment, the grip 112 may comprise a glove or similar structure to engage a user's hand. It is contemplated that appropriate structures may be used for various portions of the user's body. For instance, a belt-like structure or strap may be used for the user's torso or waist.

In one or more embodiments, the grip 112 may be removable and replaceable. This allows a variety of grips 112 to be used with the exercise apparatus. A variety of fasteners may be used to accomplish this. For example, one or more screws, threaded connectors, hook and loop fasteners, hooks, clips, clamps, or the like may be used to removably attach a grip 112. It is contemplated that a grip 112 may also be attached permanently in one or more embodiments.

The exercise apparatus may comprise a first arm 104 and a second arm 108 that are rotatable or movable in one or more embodiments. In general, such rotation is achieved by the pivot or joint 116 between the first arm 104 and the second arm 108. In one or more embodiments, the join 116 allows rotation along any axis. This allows the arms 104,108 to have a full range of motion, as will be described further below.

The joint 116 may comprise a socket 120 and a head 132 in one or more embodiments. As can be seen, the socket 120 may be attached to the first arm 104, while the head may be attached to the second arm 108. The socket 120 may be configured to rotatably accept the head 132. Typically, the socket 120 will have an inner surface having a rounded shape to allow the head 132 to rotate when the head is within or engaged to the socket. Typically, the head 132 will be a spherical or rounded shape. In one exemplary embodiment for example, the head 132 may be a sphere.

As can be seen from FIG. 1C, the head 132 and socket 120 may be sized such that the head fits snugly into the socket. This allows the head 132 to rotate smoothly within the socket 120. It is contemplated that the head 132, socket 120, or both may be formed from various materials. For example, the head 132, socket 120, or both may be formed from one or more metals, plastics, rubber or elastic materials, wood, composite materials, or a combination thereof.

The materials may be selected based on the desired amount of resistance. For example, materials having surfaces which increase friction may be used to increase resistance provided by the exercise apparatus, while materials having surfaces which reduce friction may be used to decrease resistance. In one or more embodiments, the head 132 and socket 120 may comprise different materials to provide the desired resistance. In one embodiment, the material comprises leather. In one embodiment the material comprises nylon.

The materials may also or alternatively be selected to produce the least amount of resistance, the smoothest rotation, or both. As will be described further below, an adjustable resistance assembly may be used to provide resistance. Thus, the head 132 and socket 120, in these embodiments, may be configured to produce the smoothest rotation of the arms 104,108. The adjustable resistance assembly may then be relied upon to provide resistance. Typically, this means that the head 132 and socket 120 will have smooth mating surfaces that reduce friction between the head and socket. For example, in one embodiment the head 132 may be a metal while the socket 120 may be a plastic, or vice versa.

It is contemplated that the head 132 and socket 120 may be removable and replaceable in one or more embodiments. For example, a head 132 of one material may be swapped for a head of another material to provide a different or distinct resistance. In addition, the head 132 and socket 120 may be swapped if damaged or broken. It is contemplated that the head 132 and socket 120 may be removably attached by one or more threaded connections, clips, clamps, pins, or a combination thereof to allow removability and replaceability.

A cuff 124 may be used to secure the head 132 to the socket 120. In one or more embodiments, the cuff 124 may be a ring-like shape having an opening that is less than the diameter of the head 132. The opening in the cuff 124 allows the second arm 108 to pass through the cuff. In this manner, the cuff 124 secures the head 132 and second arm 108 while allowing rotation or movement of the second arm. The opening may be large enough to allow a wide range of motion, but not so large that the cuff no longer secures the head 132 in the socket 120. As can be seen in FIG. 1C, the opening of the cuff 124 is such that a relatively large portion of the head 132 is exposed, allowing a wide range of motion for the arms 104, 108.

It is contemplated that an inner surface of the cuff 124 may be curved to accommodate the head 132. For example, an inner surface of the cuff 124 may have the same curvature as the head 132. This allows the head 132 to rotate while secured in the socket 120 by the cuff 124. It is also contemplated that the cuff 124 may be comprised of the same material as the socket 120 or a different material in one or more embodiments.

In one or more embodiments, the cuff 124 may be removable. For example, as shown in FIG. 1B, the cuff 124 has a threaded portion 136 to allow the cuff to be threaded onto the threads 140 of the socket 120. The threaded portion 136 may be on an outer surface of the cuff 124 to accept a threaded portion 140 on the inner portion of the socket 120, and vice versa. Of course the cuff 124 may be permanently attached in one or more embodiments.

It is noted that, in some embodiments, the cuff 124 may be tightened or loosened on the threads 140 of the socket 120 to respectively increase or decrease resistance to the motion of the arms 104,108. In one or more embodiments, a locking device, such as a pin, clip, clamp, or the like may be used to prevent the cuff 124 from turning and thus coming loose.

Figure 2A:
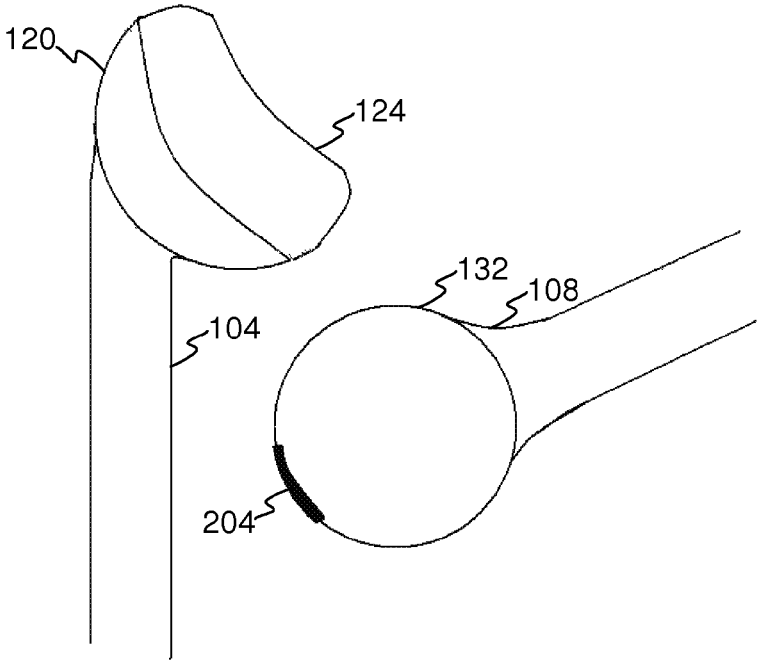
FIG. 2A is a side view of an exemplary friction pad of a total body exercise to apparatus.

In addition or instead of tightening or loosening the cuff 124, resistance provided by the exercise apparatus may be adjusted in various other ways. For example, referring to FIGS. 2A-2B, the exercise apparatus may include a friction pad 204 comprising an attachment or surface which, when in contact with the socket 120, creates resistance to the motion of the arms 104,108. It is noted that, in some embodiments, a friction pad 204 may be attached to the head 132 to provide resistance, such as shown in FIG. 2A.

Figure 2B:
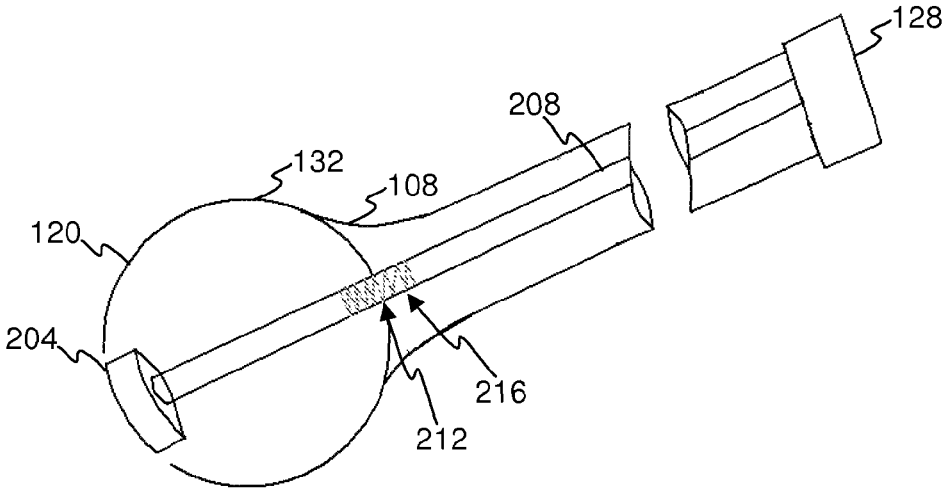
FIG. 2B is a cross section view of an exemplary resistance assembly of a total body exercise apparatus.

The friction pad 204 may be part of an adjustable resistance assembly which in general is a mechanism which allows the resistance of the exercise apparatus to be adjusted as desired. Referring to FIG. 2B, which illustrates a cross sectional view of the second arm 108, it can be seen that the friction pad 204 may be adjusted to increase or decrease the friction between the friction pad and the socket. To illustrate, in FIG. 2B, the friction pad 204 may be extended outward from the head 132 or retracted inward toward the head. The outward direction causes the friction pad 204 to exert additional force against the socket, while the inward direction causes the friction pad to reduce the force exerted against the socket. Accordingly, the friction between the friction pad 204 and the socket is respectively increased or decreased. This causes a respective increase or decrease to the resistance provided by the arms of the exercise apparatus.

It is noted that the friction pad 204 may be formed form a variety of materials. Typically, the friction pad 204 will comprise a durable material, such as one or more metals, plastics, or ceramics. The material may be textured on its surface or have a smooth surface. It is contemplated that the friction pad 204 may also provide a rounded surface to better contact the inner surface of the socket. For instance, in one embodiment, the friction pad 204 may have a rounded surface similar to that of a portion of the head.

The embodiment of FIG. 2B illustrates an example of how this adjustment capability may be achieved with an adjustable resistance assembly comprising the friction head 132, an adjustment rod 208, and a resistance control knob 128. As can be seen, the friction pad 204 is movable relative to the head 132 via an adjustment rod 208 which is connected to a resistance control knob 128 at the end of the second arm 108. In general, the control knob 128 may be rotated to move the friction pad 204 inward or outward. It is contemplated that the control knob 128 could be positioned elsewhere on the second arm 108. For example, the control knob 128 could be substantially internal to the second arm 108 with a portion of the knob being user accessible through an opening in the second arm. In this manner, the control knob 128 would be akin to a wheel rotating within the second arm 108. The rotation of the wheel would move the friction pad 204 inward or outward.

In one or more embodiments, rotation of the control knob 128 causes the adjustment rod 208 to rotate. At least a portion of the adjustment rod 208 may be threaded to translate the rotational motion into an inward or outward motion relative to the friction pad 204. For example, as shown, the adjustment rod 208 comprises a threaded portion 216 which allows the rotational motion of the adjustment rod to cause the friction pad to move inward or outward relative to the head 132.

Within the second arm 108 may be another threaded portion or opening which accepts the threaded portion of the adjustment arm 208. For example, in FIG. 2B, the second arm 108 has a threaded opening 212 at an end of the second arm 108. Typically, the threaded opening 212 will be at an opposite end of the second arm 108 than the control knob 128. It will be understood however, that the threaded opening 212 may be at various locations along the length of the second arm 108. For example, the threaded opening 212 may be at a midpoint of the second arm 108 or may be within the head 132 of the second arm or may be near the control knob 128. It is contemplated that a plurality of threaded openings 212 may be provided in one or more embodiments to further support the adjustment rod 208. Because the force applied by the adjustment rod 208 to the friction pad 204 may be substantial, additional threaded openings 212 may be advantageous in one or more embodiments.

Once the control knob 128 has been adjusted to provide the desired amount of resistance via the friction pad 204, it is contemplated that the adjustment rod 208, control knob, friction pad, or a combination thereof may be locked or secured in position to prevent the resistance from becoming reduced or increased by inadvertent or unwanted rotation of the adjustment rod 208. Of course, this is not required in all embodiments, as the pressure from the friction pad's contact with the socket may be sufficient to prevent inadvertent rotation or inadvertent adjustment of the resistance provided by the exercise apparatus.

Securing of a desired resistance, if included as a feature, may be accomplished in a variety of ways. In one embodiment, the control knob 128 may be secured to a portion of the second arm 108 to prevent further rotation. For example, one or more pins, clips, clamps, or the like may be inserted or otherwise engaged to prevent further rotation. The control knob 128 may then be released to once again allow rotation and thus adjustment of resistance, when desired. It will be understood that the adjustment rod 208, friction pad 204, or both may also or alternatively be secured to prevent further rotation.

Figure 2C:
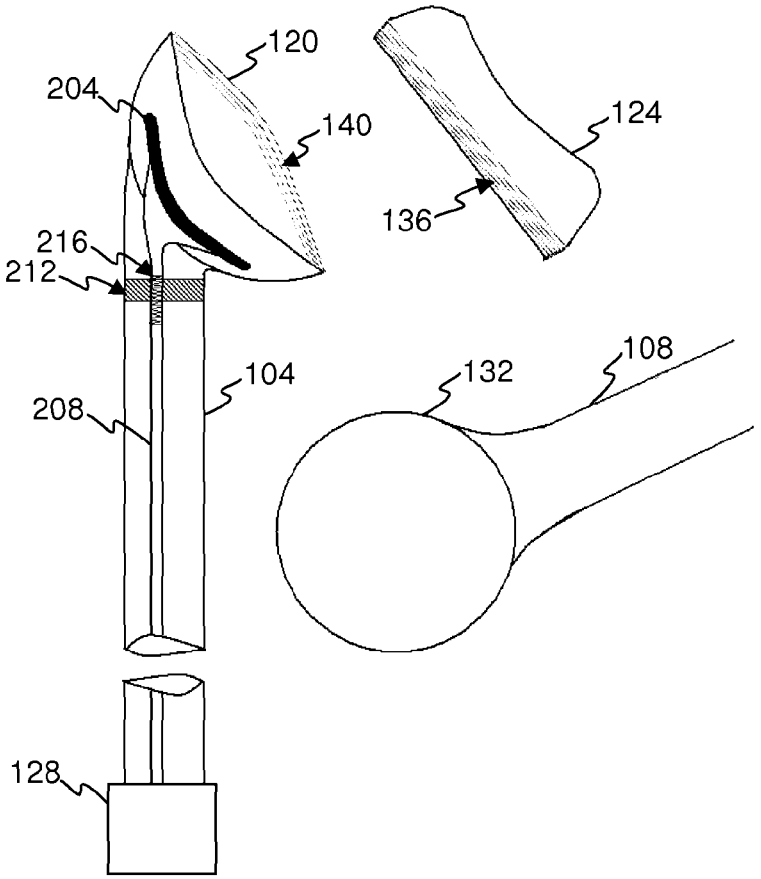
FIG. 2C is an exploded view of an exemplary total body exercise apparatus.

Though described in particular configurations, it is contemplated that the resistance assembly may have a variety of embodiments which provide resistance to the movement of the first and second arm 104,108. FIG. 2C illustrates one such embodiment where an adjustable resistance assembly is located within the first arm 104. As can be seen, the first arm 104 has a control knob 128, adjustment rod 208 with a threaded portion 216, threaded opening 212, and a friction pad 204 attached to the adjustment rod 208. Though other locations are possible, the threaded opening 212 has been positioned centrally within the first arm 104 in FIG. 2C. In like manner to the above, rotation of the control knob 128 extends or retracts the friction pad 204 to adjust the resistance provided by the resistance assembly. Because the resistance assembly is associated with the first arm 104, the friction pad 204 moves within the socket 120 as can be seen from FIG. 2C.

The friction pad 204 may comprise various shapes. As can be seen from FIG. 2C for instance, the friction pad 204 has been curved such as to receive the head 132 of the second arm 108. Likewise, an end of the adjustment rod 208 has been shaped to support the friction pad 204 of this configuration. Of course other shapes, including those discussed above, may be used for the friction pad 204 as well as the supporting portion of the adjustment rod 208. It is noted that one or more friction pads 204 may be on the head 132 of the second arm and within the socket 120 of the first arm in some embodiments. Alternatively or in addition, the head 132, socket 120, or both may have a "rough" surface such as to perform the function of a friction pad 204.

As stated, the exercise apparatus allows exercise of the user's entire body. Some exemplary exercises will now be described. Referring back to FIG. 1A, in operation, a user may perform upper body exercises by grasping the arms 104,108 and moving the arms. As the arms 104,108 are moved, the user overcomes the resistance provided by the joint 116. This tones and strengthens the user's muscles. Because the joint 116 allows the arms 104,108 to move in virtually any direction while providing resistance, the user exercises a broad selection of muscles as he or she exercises. For example, in contrast to a traditional exercise device, a user doing arm exercises may train both his or her biceps and triceps by moving the arms 104,108 towards and away from each other in any direction or angle.

The user may perform lower body exercises by moving the arms 104,108 with the user's lower body, such as the user's thighs, legs, or feet. The user may engage the arms 104,108 directly or through one or more grips 112. As stated, the grips 112 may secure the arms 104,108 to a user's body thus allowing the arms to be moved even when the user does not grasp the arms.

For example, the arms 104,108 may be strapped to a user's legs and exercise performed by the user moving his or her legs thereby overcoming the resistance provided by the arms of the exercise apparatus. It is noted that the arms 104,108 need not be engaged by corresponding body parts. For example, an exercise need not be performed by engaging the exercise apparatus with the user's left and right hand or left and right leg. An exercise may be performed by engaging various of the user's body parts. To illustrate, an exercise may be performed by engaging the first arm 104 to the users torso and the second arm 108 to a user's arm or hand. Likewise, the first arm 104 may be engaged to the users leg or thigh while the second arm 108 is engaged to a user's hand or arm. It will be understood that a variety of combinations are possible with the exercise apparatus. It is contemplated that an arm of the exercise apparatus may also be fixed or secured to another object and that the user may then exercise by moving the free arm of the exercise apparatus.

To allow total body exercise, in one or more embodiments the arms 104,108 may be lengthened or shortened. As stated above, the arms 104,108 may be extendable or collapsible. Alternatively the arms 104,108 may comprise modular sections which may be added or removed to respectively lengthen or shorten the arms. In this manner, exercises involving the outermost extremities of the user's body (or other exercises) may be performed. For example, in one exercise, the first arm 104 may be placed parallel to the floor and engaged by the user's foot such that the joint 116 is on the floor and in front of the user. The second arm 108 may then be lengthened to reach the user's hands to provide an upper body workout.

The exercise apparatus broad range of motion also allows it to be used to enhance traditional exercises. For example, the exercise apparatus may be "worn" during traditional exercise to increase resistance or provide different resistance than the exercise alone. To illustrate, an arm curl with an elastic band apparatus provides resistance to the upward motion of a user's arm but no resistance to the downward motion. By engaging the exercise apparatus to the user's arm, resistance may be provided against the downward motion and resistance to the upward motion may be enhanced. In addition, engaging the exercise apparatus such that the joint 116 is at the user's elbow helps support the user's body structure and elbow joint, thus reducing the risk of injury. This same principle may be applied to various of the user's joints during exercise.

It is noted that two or more exercise apparatus may be used by one user if desired. For example, the user may perform simultaneous exercises on his or her left and right sides. In these situations, an attachment or mount may be provided, such as on a socket 120 of the exercise apparatus to allow two or more exercise apparatus to be connected. To illustrate, two exercise apparatus may be connected at their sockets 120 to form an X-shaped exercise apparatus that may be engaged by the user's hands and feet simultaneously. Of course, two or more exercise apparatus may be used without being connected.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A exercise apparatus comprising:

a first elongated arm comprising a first end and a second end, the first end having a socket and the second end having a grip;

a second elongated arm comprising a first end and a second end, the first end having a spherical head and the second end having a grip, the second elongated arm having an adjustment rod such that the entire length of the adjustment rod is located within the second elongated arm and the adjustment rod is secured within the second elongated arm to thereby remain in the second elongated arm during use of the exercise device;

a joint comprising the socket, the spherical head, and a cuff, the cuff comprising an opening to accept the second arm, wherein the cuff secures the spherical head within the socket; and an adjustable resistance assembly comprising a friction pad extending from the spherical head, a control knob at the second end of the second elongated arm, and the a-n adjustment rod between the friction pad and the control knob, the adjustment rod comprising a threaded portion supported by a threaded opening within the second arm, wherein rotation of the control knob rotates the adjustment rod causing the friction pad to extend or retract relative to the spherical head.

2. The apparatus of claim 1 wherein the cuff comprises a round ring.

3. The apparatus of claim 2 wherein the cuff is external to the socket and head, and has threads that attach the cuff to the socket.

4. The apparatus of claim 1, wherein the friction pad comprises leather.

5. The apparatus of claim 1, wherein the head comprises nylon which engages the friction pad to resist movement of the first arm relative to the second arm.

6. The exercise apparatus of claim 1, wherein the control knob is exposed on the grip of the second elongated arm to change resistance between the friction pad and the spherical head.

7. An exercise apparatus comprising:

a first elongated arm comprising a first end and a second end, the first end having a socket, the second end configured to be engaged by a hand of a user during use of the exercise apparatus;

a second elongated arm comprising a first end and a second end, the first end having a head, the second end configured to be engaged by a hand of a user during use of the exercise apparatus;

a cuff comprising a ring having a central opening sized to accept the second arm, wherein the cuff includes threads which interface with threads on the socket to secures the head within the socket and the cuff is located external to the head and external to the socket such that the cuff is configured to be rotated relative to the socket to loosen or tighten the cuff on the socket; and a resistance assembly comprising a friction pad configured to adjust the friction relative to movement of the first arm in relation to the second arm to establish the first elongated arm repeatedly movable relative to the second arm subject to the friction.

8. The apparatus of claim 7, wherein the friction pad is adjustable between a first position and a second position to adjust friction.

9. The apparatus of claim 7 wherein the first elongated arm includes a bend adjacent to the socket and the second elongated arm includes a adjacent to the head.

10. The apparatus of claim 7, further comprising a screw type adjuster to adjust the position of the friction pad.

11. The apparatus of claim 7, wherein the cuff releasably connects to the socket and adjusts the friction of the friction pad.

12. The apparatus of claim 10, wherein the screw type adjuster is at an end of the first elongated arm or second elongated arm and the screw type adjustor connects to a adjustment member that also connects to or moves the friction pad, the adjustment member completely contained within either of the first elongated arm or second elongated arm.

* * * * *